United States Patent [19]

Tokuno

[11] 3,948,715

[45] Apr. 6, 1976

[54] AUTO-DETECTING MEANS FOR DETECTING DRAWNOUT TERMINATION END OF OLD PAPER ROLL AND BEGINNING END OF NEW PAPER ROLL IN PAPER SPLICING APPARATUS

[75] Inventor: Masateru Tokuno, Nishinomiya, Japan

[73] Assignee: Rengo Co., Ltd., Osaka, Japan

[22] Filed: Nov. 6, 1973

[21] Appl. No.: 413,327

[30] Foreign Application Priority Data

May 21, 1973 Japan ..... 48-57066
July 25, 1973 Japan ..... 48-84413

[52] U.S. Cl. ..... 156/351; 242/58; 242/58.1
[51] Int. Cl.[2] ..... B65H 19/08; B65H 25/14
[58] Field of Search ..... 200/61.13, 61.18, 61.39, 200/61.4, 61.41, 61.42; 317/DIG. 2; 242/58–58.6; 340/256; 156/351, 353, 361

[56] References Cited

UNITED STATES PATENTS

| | | | |
|---|---|---|---|
| 1,933,886 | 11/1933 | Wood | 200/61.16 X |
| 2,097,053 | 10/1937 | Zalesak | 200/61.16 X |
| 2,135,975 | 11/1938 | Horton | 200/61.16 X |
| 2,801,308 | 7/1957 | Cubellis | 200/61.41 X |
| 3,286,249 | 11/1966 | D'Angelo | 200/61.15 X |
| 3,619,523 | 11/1971 | Tanabe | 200/61.41 |
| 3,757,171 | 9/1973 | Stansfield | 317/DIG. 2 |

*Primary Examiner*—James R. Scott
*Attorney, Agent, or Firm*—Stewart and Kolasch, Ltd.

[57] ABSTRACT

A paper splicing apparatus which splices the drawn-out portion of an exhausting paper roll with the binding surface of a new fully wound paper roll, which is being continuously rotated by using paper splicing rolls, wherein means are provided for automatically detecting the end of the old paper roll being drawn-out and the beginning end of the new or fresh paper roll which is being rotated in a fully wound form. The paper rolls are supported by a pair of shafts rotatably mounted on a pair of arms supported by a supporting stand.

5 Claims, 23 Drawing Figures

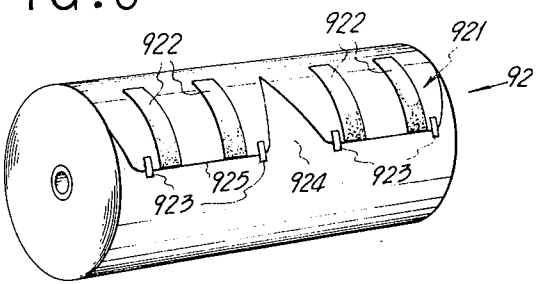
FIG. 5
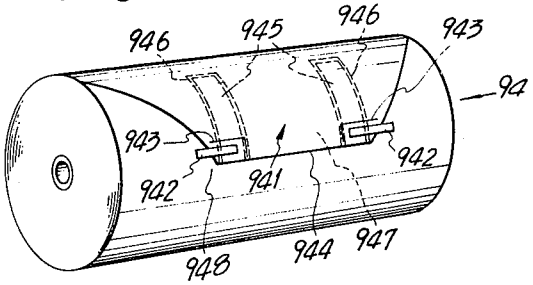
FIG. 6
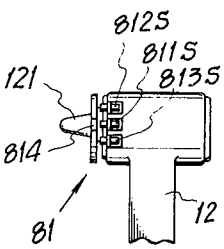
FIG. 2
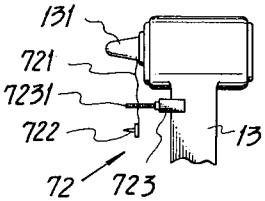
FIG. 3
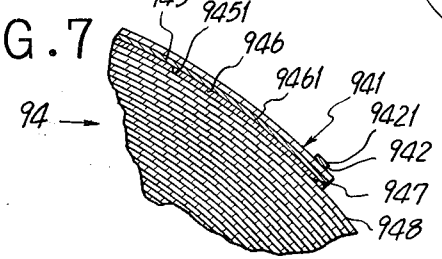
FIG. 7
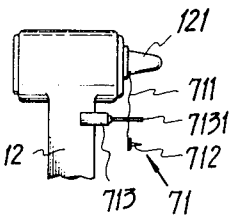
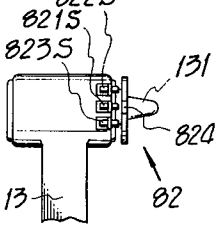

AUTO-DETECTING MEANS FOR DETECTING DRAWNOUT TERMINATION END OF OLD PAPER ROLL AND BEGINNING END OF NEW PAPER ROLL IN PAPER SPLICING APPARATUS

The present invention relates to a means for automatically detecting the end of an old paper roll being drawn out and the beginning of a new fully wound paper roll which is being continuously rotated. The paper splicing apparatus of the present invention splices the drawn-out portion of the old paper roll with the binding surface of a new paper roll, which is being rotated in a fully wound form, by use of paper splicing rolls, and cuts away the remaining portion of the old paper roll when said paper roll has been almost exhausted.

Conventionally, in performing a splicing operation for paper rolls utilizing a paper splicing apparatus, it has been difficult to determine the end of the old paper roll being drawn out and therefor it has been difficult to splice the old paper roll with the new paper roll, without superimposing a large portion of the old paper with the new paper roll.

An object of the present invention is to provide a means for splicing an old paper roll with a new paper roll after the old paper roll has been sufficiently used up and also to a means for automatically detecting the position of the drawn-out end of the old paper roll and the beginning end of the new paper roll being drawn out, whereby the old paper roll is spliced with the new paper roll so that the superimposed positions thereof are reduced to a minimum.

Figure 1:
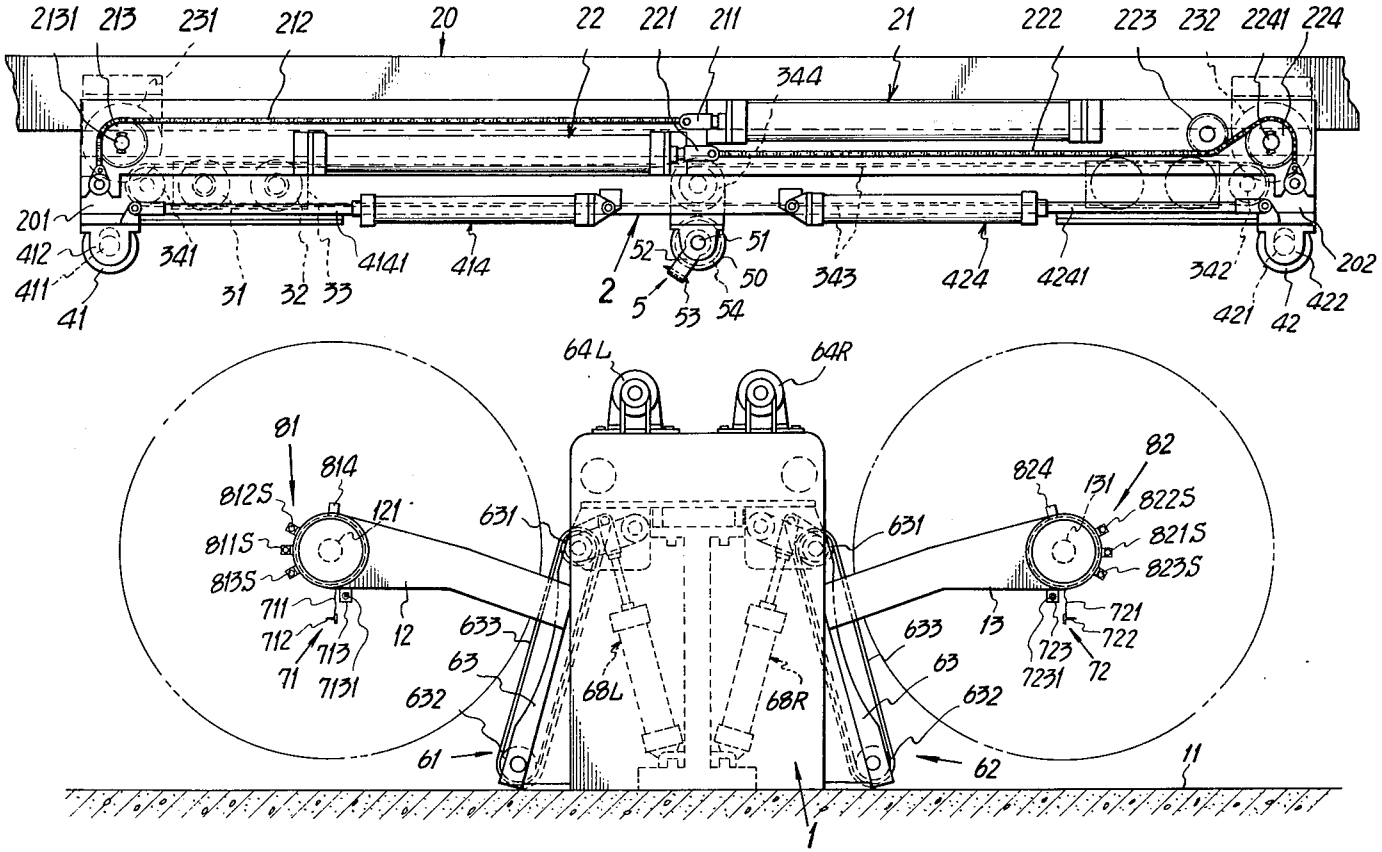
Figures 2A, 3A:
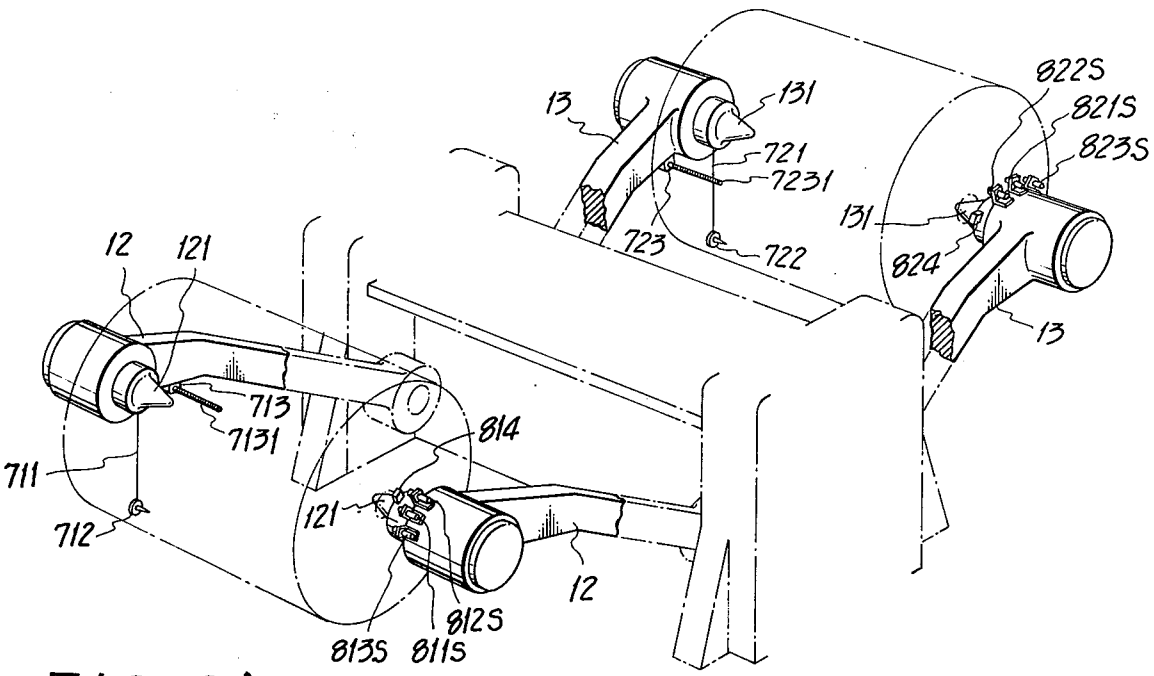
Figure 4:
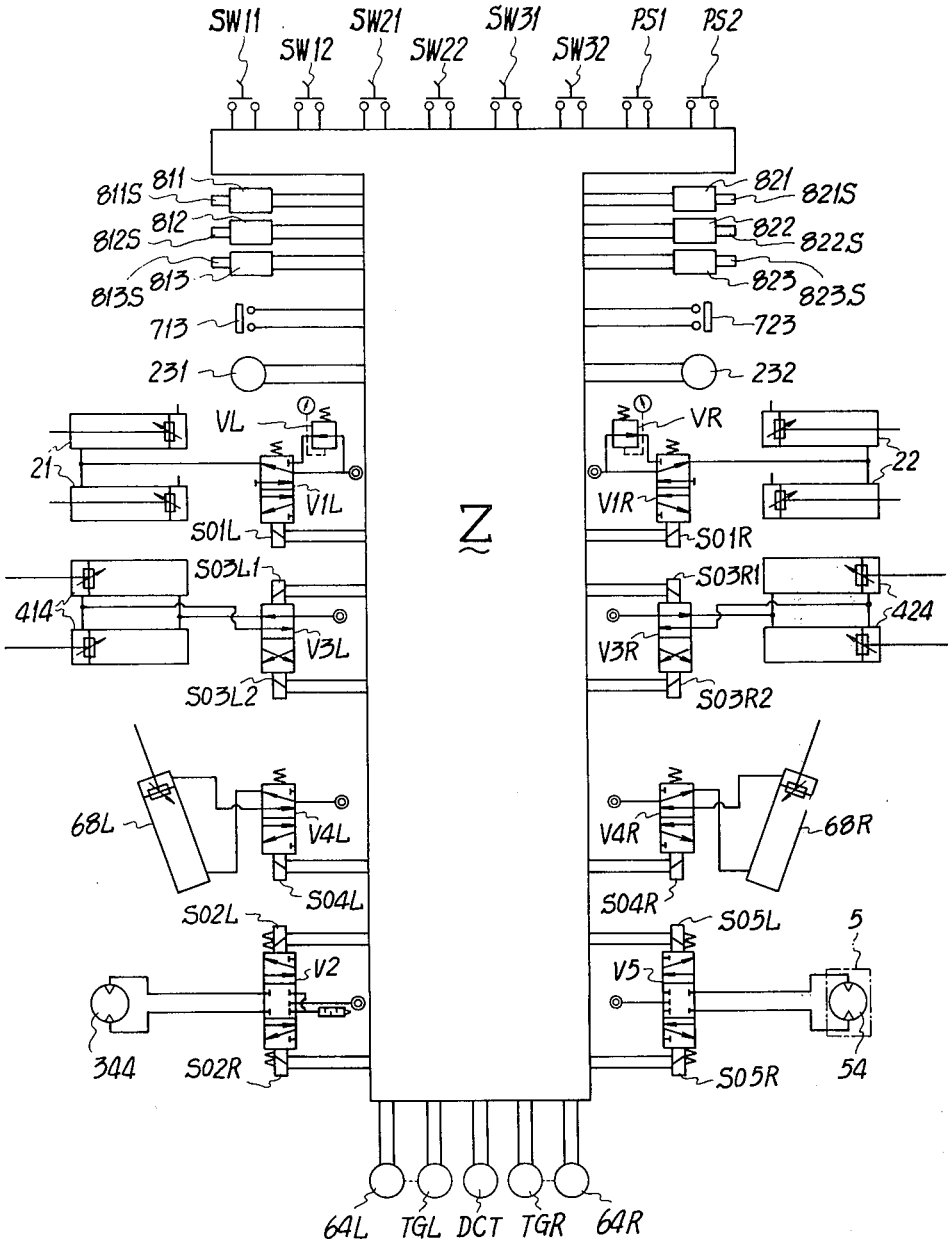
Figure 19:
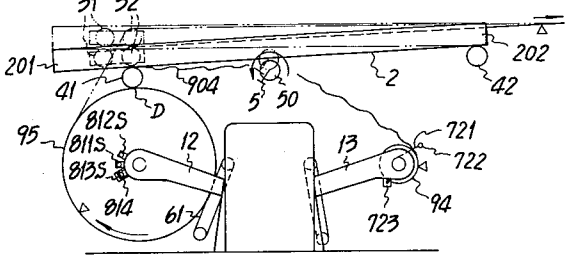
Figure 21:
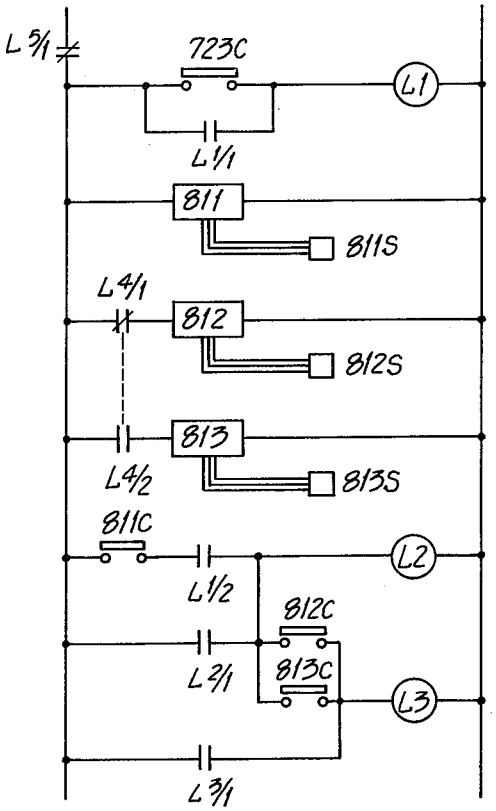
Figure 20:
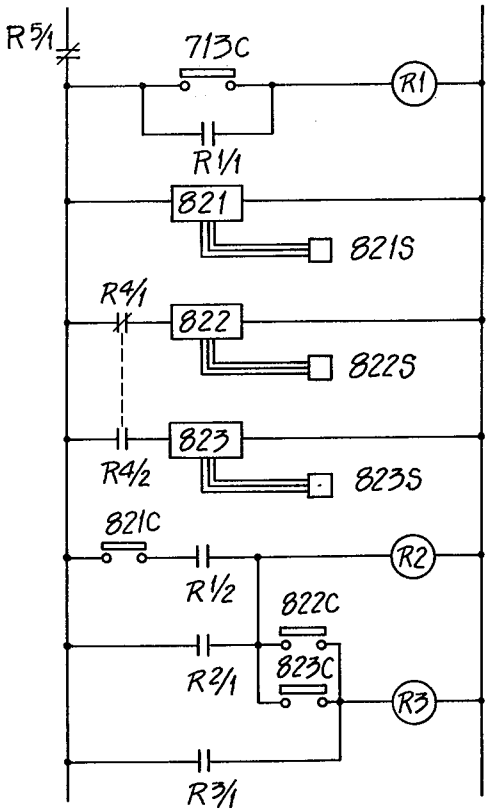

The other objects of the present invention will become apparent from the following full description of the present invention taken in conjunction with preferred embodiments thereof with reference to the accompanying drawings, in which;

FIG. 1 is a side view showing a paper splicing apparatus in accordance with the present invention, FIG. 2 is a profile showing the auto-detecting means for automatically detecting the drawn-out end of the old paper roll which is disposed on the front side of a mill stand, and the fresh end of the new paper roll which is being drawn out, FIG. 2A is a perspective view showing a pin, a limit switch, and sensors of proximity switches fitted on a pair of arms on the front side of the mill stand, FIG. 3A is a perspective view similar to FIG. 2A showing a pin, a limit switch, and sensors of proximity switches fitted on a pair of arms on the back side of the mill stand, FIG. 3 is a profile view showing the means for automatically detecting the drawn-out end of the old paper roll which is disposed on the rear side of the mill stand, and the fresh end of the new paper roll which is being drawn out, FIG. 4 is a schematic diagram illustrating the electric control system for the paper splicing apparatus in accordance with the present invention, FIG. 5 is a perspective view showing one improved new paper roll for the paper splicing operation, FIGS. 6 and 7 are respectively a perspective view and a partially enlarged sectional view showing another improved new paper roll for the paper splicing operation, FIGS. 8 to 19 are illustration views, showing a paper splicing operation by the paper splicing apparatus according to the present invention, FIGS. 20 and 21 are electrical circuit diagrams showing the operation of the limit switches and the proximity switches.

The apparatus of the present invention will be described in conjunction with a paper splicing apparatus for corrugated board linder paper rolls.

As understood from FIG. 1, a mill stand is erected on a foundation 11. The mill stand 1 is equipped with a pair of arms 12 and 12 on its front side and with a pair of arms 13 and 13 on its rear side (see FIGS. 2A and 3A). Shafts 121 and 121 are respectively projected rotatably from each tip end of the arms 12 and 12 to allow the paper roll to be rotatably supported therebetween, while shafts 131 and 131 are respectively projected rotatably from each tip end of the arms 13 and 13 to allow the paper roll to be rotatably supported therebetween. A roll support frame 2 is positioned above the mill stand 1, extending from above one paper roll supported by the mill stand to above the other paper roll supported by said mill stand. One end portion 201 of the roll support frame 2 is suspended, by means of chains 212 and 212, from the piston rods 211 and 211 on a pair of air cylinders 21 and 21 which are secured to a frame 20 above the mill stand 1, while the other end portion 202 thereof is suspended, by means of chains 222 and 222, from the piston rods 221 and 221 on a pair of air cylinders 22 and 22 which are secured to the frame 20. Only one cylinder 21, one rod 211, one chain 212, one cylinder 22, one rod 221 and one chain 222 are shown in the drawings. Each chain 212 is guided by means of a guide sprocket 213 fitted to the frame 20. A dry type multiple plate electromagnetic brake 231 which is secured to the frame 20 is connected to a shaft 2131 on the guide sprocket 213. Also, each chain 222 is guided by means of guide sprockets 223 and 224 which are mounted to the frame 20. A dry type multiple plate electromagnetic brake 232 which is secured to the frame 20 is connected to a shaft 2241 on the sprocket 224. A pair of roll shaft mounting plates 33 and 33 are fitted to the roll support frame 2 so that they may be reciprocatable from near one end portion 201 of the roll support frame 2 to near the other end portion 202 thereof, and a pair of parallel main paper splicing rolls 31 and 32 are bridged and rotatably mounted between these roll shaft mounting plates. Only one plate 33 is shown in the drawings. Also, a pair of sprockets 341 and 341 are mounted in one end portion 201 of the roll support frame 2, while a pair of sprockets 342 and 342 are mounted in the other end portion thereof. Only one sprocket 341 and one sprocket 342 are shown in the drawings. Roll shaft mounting plates 33 and 33 are coupled to endless chains 343 and 343 entrained on these sprockets and accordingly the roll shaft mounting plates 33 and 33 can be moved by rotating of the endless chains. Only one chain 343 is shown in the drawings. The endless chains are driven, through a chain transmission gear (not shown), by an air motor 344 which is secured to the roll support frame 2. A pair of bearing cases 412 and 412 are suspended on the under face of the end portion 201 of the roll support frame 2 so that they may slide towards the roll support frame end portion 202. Only one can 412 is shown in the drawings. An auxiliary paper splicing roll 41 is rotatably carried by bearings 411 and 411 which are fitted, with a slight amount of play, into the bearing cases. Only one bearing 411 is shown in the drawings. The bearing cases 412 and 412, which are coupled to the piston rods 4141 and 4141 on a pair of air cylinders 414 and 414 mounted in the roll support frame 2, are moved by the air cylinders. Only one cylinder 414 and one rod 4141 are shown in the drawings. A pair of bearing cases 422 and 422 are suspended on the under face of the end portion 202 of the roll support frame 2 so that they may slide towards the roll support frame end portion 201. Only one case 412 is shown in the drawings. An auxiliary paper splicing roll 42 is rotatably carried by bearings 421 and 421 which are fitted, with a slight vertical play into the bearing cases. The bearing cases 422 and 422, which are coupled to the piston rods 4241 and 4241 on a pair of air cylinders 424 and 424 mounted in the roll support frame 2, are moved by the air cylinders. Only one cylinder 424 and one rod 4241 are shown in the drawings.

A paper guide roll 50 and a cutter 5 are suspended on the under face of the central portion of the roll support frame 2. The cutter 5 has a knife 53 secured, through arm levers 52 and 52, (only one lever 52 is shown in the drawings to a shaft 51 rotatably mounted on the under face of the roll support frame 2. The shaft 51 is adapted to be rotated in a reciprocating manner by an oscillating air motor 54 which is secured to the roll support frame 2. The paper guide roll 50 is loosely engaged with the shaft 51.

A device 61 for rotating a new paper roll is provided on the front face side of the mill stand 1, while a device 62 for rotating a new paper roll is provided on the rear face side thereof. Devices 61 and 62 are referred to as predrivers 61 and 62 hereinafter. Each predriver has an upper pulley 631 and a lower pulley 632 rotatably mounted in a pulley shaft mounting frame 63 the top portion thereof being rotatably mounted to and suspended from the mill stand 1. An endless belt 633 is entrained on these pulleys, and the frame 63 is oscillated by means of an air cylinder 68L (an air cylinder 68R in case of the predriver 62) mounted in the mill stand 1, permitting the belt 633 to freely contact with and separate from the paper roll which is supported by the mill stand 1. The upper pulley 631 is adapted to be rotated by means of a D.C. motor 64L (a D.C. motor 64R in case of the predriver 62).

As understood from FIGS. 1 and 2A, a pin 712 is connected through a wire 711 to a shaft 121 mounted on one arm 12 on the front side of the mill stand 1. The pin 712 can be inserted into the end face of the paper roll which is supported by the shaft 121 and 121, and can be disengaged from the paper roll due to the reduction of the paper roll so that the pin may be swung around together with the wire 711. A limit switch 713 is secured on the arm 12 so that the swinging pin 712 or wire 711 can collide with a coil spring-like detecting portion 7131 of the switch 713. The limit switch 713 has its normally open contact closed by collision of the pin or the wire therewith. As understood from FIGS. 1 and 2, the sensors 811S, 812S and 813S for the proximity switches 811, 812 and 813 are secured on the other arm on the front side of the mill stand 1. The sensor 812S is secured in a position turned through 45°, in the clockwise direction in FIG. 1, from the sensor 811S, while the sensor 813S is secured in a position turned through 45° in the clockwise direction in FIG. 1 from the sensor 811S. A magnet 814 as a sensed material for inducing the sensors 811S, 812S and 813S is secured on the shaft 121 by magnetic forces. As understood from FIGS. 1 and 3A, a pin 722 is connected through a wire 721 to a stand 131 mounted on one arm 13 on the backside of the mill stand 1. The pin 722 can be inserted into the end face of the paper roll supported by the shaft 131 and 131 and can be disengaged from the paper roll due to reduction of the paper roll so that the pin may be swung around by the wire 721. A limit switch 723 is securedd on an arm 13 so that the swinging pin 722 on the wire 721 can collide with a coil spring-like detecting portion 7231 of the switch 723. The limit switch 723 has its normally open contact closed by collision of the pin or the wire therewith. As understood from FIG. 1 and FIG. 3, the sensors 821S, 822S and 823S for the proximity switches 821, 822 and 823 are secured on the other arm 13 on the backside of the mill stand 1. The sensor 822S is located in a position turned 45° in the clockwise direction in FIG. 1, from the sensor 821S while the sensor 823S is located in a position turned 45° in the clockwise direction in FIG. 1 from the sensor 821S. A magnet 824, as a sensed material for inducing the sensors 821S, 822S and 823S is secured on the shaft 131 by magnetic forces.

In a controlling board Z as shown in FIG. 4, there is incorporated an electric circuit for electrically controlling solenoid-operated valves V1L and V1R connected to the air cylinders 21, 21 and 22, 22 for raising and lowering the roll support frame, electromagnetic brakes 231 and 232 for suspending the descent motion of the roll support frame 2, a solenoid-operated valve V2 connected to an air motor 344 for use in moving the roll shaft mounting plates, solenoid-operated valves V3L and V3R connected to the air cylinders 414, 414 and 424, 424 for use in moving the auxiliary paper splicing rolls, solenoid-operated valves V4L and V4R connected to the air cylinders 68L and 68R for predrivers 61 and 62, and a solenoid-operated valve V5 connected to D.C. motors 64L and 64R for the predrivers 61 and 62, and to an oscillating air motor 54 for the cutter 5. Also, in the controlling board, there are additionally provided an operation switch SW11 for moving the roll shaft mounting plates 33 and 33 to left, in FIG. 1, and an operation switch SW12 for moving them to right; an operation switch SW21 for descending the one end portion 201 of the roll support frame 2 up to a paper splice preparing position, and an operation switch SW22 for descending the other end portion 202 of the roll support frame 2 up to a paper splice preparing position; operation switches SW31 and SW32 for moving auxiliary the auxiliary paper splicing rolls 41 and 42; and operation switches PS1 and PS2 for driving the predrivers 61 and 62. The operation circuit for the brakes 231 and 232 is constructed so that the brake may be removed upon closure of the switches SW21 and SW22, respectively, for descending the end portion of the roll support frame 2 to the paper splicing preparation position, and may be applied upon opening of the switches SW21 and SW22 halfway the descending operation of the roll support frame end portion. The D.C. motors 64L and 64R for the predrivers 61 and 62 are controlled in rotation speed by input to the controlling board Z from a speed detection motor DCT for detecting the running speed of the old roll paper and by feed back input to the controlling board Z from motors TGL and TGR for detecting the rotation speed of the D.C. motors 64L and 64R, and finally are rotatingly controlled so that the peripheral speed of the new paper roll may coincide with the running speed of the paper from the old paper roll. Also, an operation circuit for the D.C. motor 64L is constructed to rotate the new paper roll counter-clockwise, in FIG. 1, upon opening of the operation switch SW31 for use in moving the auxiliary paper splicing rolls, and also, to rotate the new paper roll clockwise, in FIG. 1, upon closure of the operation switch SW31. An operation circuit for the D.C. motor 64R is constructed to rotate the new paper roll counter-clockwise, in FIG. 1, upon opening of the operation switch SW32 for use in moving the auxiliary paper splicing rolls, and also, to rotate the new paper roll counter-clockwise, in FIG. 1, upon closure of the operation switch SW32.

Furthermore, the controlling board Z includes an electric circuit comprising a limit switch 713 and proximity switches 821, 822, and 823, the circuit being shown fully in FIG. 20. Referring to FIG. 20, 713C is an open contact for the limit switch 713, 812C is an open contact for the switch 821, 822C is an open contact for the switch 822, and 823C is an open contact for the switch 823. R1, R2 and R3 are respective relays. The relay R2 is adapted to control an operating circuit (not shown) for a brake 232 to permit the brake 232 to be cut off in order to bring the running paper into contact with the new paper roll by further lowering an end portion 202 of a frame 2, which is stopped in its descent in the paper splicing preparation position. Upon exciting the relay R2, the brake 232 is cut off. The relay R3 is adapted to control an operating circuit (not shown) for a valve V5 to permit a solenoid SO5R for a valve V5 to be excited in order to actuate a cutter 5 just before the fresh end of the new paper roll is spliced with the running expiring paper roll. Upon exciting of the relay R3, the cutter 5 is actuated. R1/1 and R1/2 show an open contact for the relay R1 respectively, R2/1 is an open contact for the relay R2, and R3/1 is an open contact for the relay R3. R4/1 and R4/2 are a closed contact and an open contact for a relay (not shown) to be excited upon closure of the switch SW32 to use an auxiliar paper splicing roll 42. R5/1 is a closed contact for a resetting relay (not shown), which is temporarily excited due to closure of an open contact of a timer relay (not shown) which starts to count time simultaneously with excitation of the relay R3. Furthermore, the controlling board Z includes an electric circuit comprising a limit switch 723 and proximity switches 811, 812, and 813, the circuit being fully shown in FIG. 21. Referring to FIG. 21, 723C is an open conta-t for the limit switch 723, 811C is an open contact for the switch 811, 812C is an open contact for the switch 812, and 813C is an open contact for the switch 813. L1, L2 and L3 show respective relays. The relay L2 is adapted to control an operating circuit (not shown) for a brake 231 to permit the brake 231 to be cut off in order to bring the running paper into contact with the new fresh paper roll by further lowering an end portion 201 of the frame 2, which is stopped in its descent in the paper splicing preparation position. Upon exciting the relay L2, the brake 231 is cut off. The relay L3 is adapted to control an operating circuit (not shown) for a valve V5 to permit a solenoid SO5L for the valve V5 to be excited in order to actuate a cutter 5 just before the fresh end of the new paper roll is spliced with the running expiring paper roll. Upon exciting of the relay L3, the cutter 5 is actuated. L1/1 and L1/2 show an open contact for the relay L1 respectively, L2/1 is an open contact for the relay L2 and L3/1 is an open contact for the relay L3. L4/1 and L4/2 are a closed contact and an open contact for a relay (not shown) to be excited upon closure of the switch SW31 to use an auxiliary paper splicing roll 41. L5/1 is a closed contact for resetting relay (not shown), which is temporarily excited due to closure of an open contact of a timer relay (not shown) which starts to count time simultaneously with the excitation of the relay L3.

The paper splicing operation using the paper splicing apparatus in accordance with the present invention will be described hereinafter.

Figure 8:
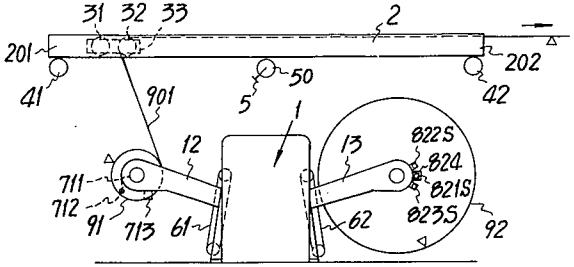
Figure 9:
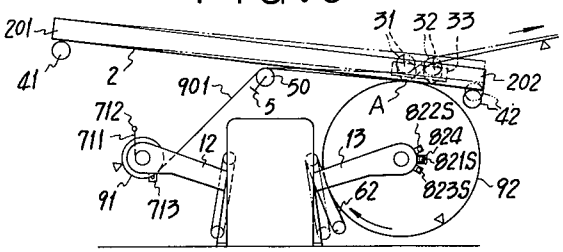

FIG. 8, shows the splicing operation of a front-face-outside-winding paper roll 92 (the front face thereof is outside, the reverse face thereof being indicated by Δ mark in FIG. 8) with a reverse-face-outside-winding paper roll 91 being drawn out, (the reverse face thereof is outside, the reverse face thereof being indicated by Δ mark in FIG. 8) said paper rolls being supported by means of arms 12 and 12 on the front face side of the mill stand 1. In order to prepare the paper splicing operation, as shown in FIG. 5, double face adhesive tapes 922, 922, 922, 922 are applied, in advance, upon the outer face of the beginning end 921 of the paper roll 92 to be drawn out, while double face adhesive tapes 923, 923 923, 923, which are respectively much smaller, in area, than the double face adhesive tapes 922, are applied on the beginning end 921 and on the outer face 924 of the roll paper thereby temporarily fastening the drawn-out beginning end 921 on the outer face 924 of the paper roll. The paper roll 92 is supported by means of arms 13 and 13 so that it may be drawn out through a clockwise-rotation as shown in the drawing. Furthermore, a pin 712, which is connected to the shaft 121 of, is inserted into the drawn-out end portion from the end face of the old paper roll 91. The edge 925 of the drawn-out beginning end 921 is aligned in a position A, through manual operation of the new paper roll 92, where the paper 801 from the expiring paper roll comes into contact with the new paper roll 92, as illustrated in FIG. 9, whereupon the splicing operation of the roll papers takes place. Under this condition, a magnet 824 approaches close to the sensor 821S thereby to re-fix to the shaft 131. Subsequently, as the old paper roll 91 becomes small, the operation switch SW12 for moving the roll shaft mounting plates is closed thereby to excite the solenoid SO2R of the solenoid-operated valve V2. Thus, the air motor 344 is rotated to move the roll shaft mounting plates 33 and 33 to near the end portion 202 of the roll support frame 2. Thereafter, the switch SW22, in the controlling board Z, for lowering the end portion 202 of the roll support frame 2 to the paper splicing preparation position is closed to excite the solenoid SO1R of the solenoid-operated valve V1R. Thus, the end portion 202 of the roll support frame 2 is gradually lowered to the paper splicing preparation position by its self-weight by the operation of a pressure regulating valve VR (see FIG. 4) which is low-pressure regulated in advance. The main paper splicing roll 31 is placed immediately near the new paper roll 92 and the switch SW22 is open, whereby the electromagnetic brake 232 is operated to hold the roll support frame 2 in this position (see the portion indicated with imaginary lines in FIG. 9). Then, the switch PS2, in the controlling board Z, for operating the predriver is closed to rotate the motor 64R for the predriver 62, while the solenoid SO4R for the solenoid-operated valve V4R is excited to cause the belt 633 of the predriver 62 to come into pressing contact with the new paper roll 92 for rotating the new paper roll 92 in the clockwise direction. The new paper roll is rotated with a peripheral speed which is equal to the drawing-out speed of the old paper roll as described hereinbefore.

Figure 11:
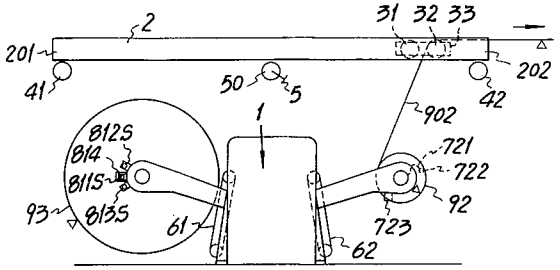
Figure 12:
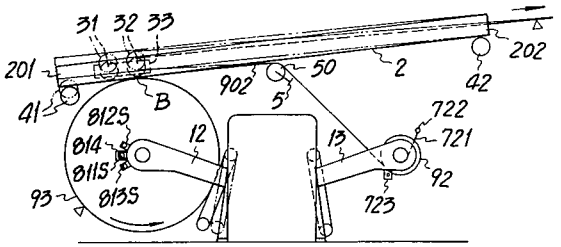
Figure 10:
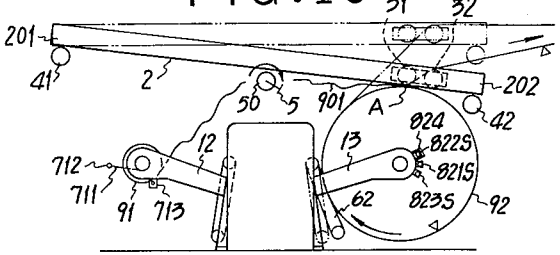

After the volume of the old paper roll 91 is reduced up to the drawing-out end, the pin 712 is released from the paper roll 91 and thus swinging freely. Accordingly, the wire 711 or the pin 712 collides with the detecting portion 7131 of the limit switch 713 to close the normally open contact 713 of the limit switch. The relay R1 (see FIG. 20) is excited due to closure of the contact 713C. The relay R1 is maintained in the excited state due to closure of the contact R1/1, thus retaining the closure of the contact R1/2. Upon the approaching of the magnet 824 to the sensor 821S for the first time after the excitation of the relay R1, the contact 812C for the proximity switch 821 is closed and the relay R2 is excited. The relay R2 is maintained in an excited state due to the closure of the contact R2/1. The brake 232 is cut off due to the excitation of the relay R2 to let the roll support frame 2 begin to descend again, whereby the paper 901 from the old paper roll is pressed against the new paper roll 92 by means of the roll 31 as illustrated with the solid line in FIG. 9. At this time, the beginning end 921 of the new paper roll being drawn out has already passed the position A, and the magnet 824 approaches the sensor 822S right before the edges 925 of the drawing-out beginning end 921 is rotated to the position A again. The contact 822C for the switch 822 is closed due to the approaching magnet 821 and the excitation of the relay R3. The relay R3 is maintained in an excited state due to the closure of the contact R3/1. Relay R3 excites the solenoid SO5R of the solenoid-operated valve V5 for rotating the cutter 5 in the clockwise direction, in the drawing, as illustrated in FIG. 10, whereby the paper 901 from the old paper roll is cut away. The new paper roll 92 is rotated as it is, and the unapplied faces of the double-face adhesive tapes 922, 922, 922, 922 and 923, 923, 923, 923, on the beginning end 921 to be drawn out are applied on the paper 901 from the old paper roll. Thus, the paper splicing operation, wherein the inside and outside of the roll papers are aligned, is completed. Thereafter, the roll support frame 2 and the predriver 62 are restored to its original condition by operation of a reset timer circuit in the controlling board Z. The roll shaft mounting plates 33 and 33 are suspended as they are near the end portion 202 of the roll support frame, and the cutter 5 is also suspended in place. Also, the contact R5/1 (see FIG. 20) for resetting the relay is opened temporarily to demagnetize the relays R1, R2 and R3. Subsequently, as illustrated in FIG. 11, the above-described paper splicing operation is performed in the same manner in splicing the reverse-face-outside-winding new paper roll 93, which is carried on the front face side of the mill stand 1, with the paper roll 92 which is carried on the rear face side of the mill stand 1. Namely, the beginning end portion of the new paper roll 93 to be drawn out is constructed, in advance, in the same structure as the beginning end portion of the paper roll 92. The new paper roll 93 is rotated manually to align an edge of the beginning end of the paper roll 93 with a paper splicing position B. Thereafter, the magnet 814 approaches close to the sensor 811S to refit it to the shaft 121. The pin 722 is inserted into the drawn-out end portion from the end face of the paper roll 92. Then, the operation switch SW11 for moving the roll shaft mounting plates is a closed to excite the solenoid SO2L of the solenoid-operated valve V2, and the air motor 344 is rotated to move the roll shaft mounting plates 33 and 33 to near the end portion 201 of the roll support frame. Thereafter, the switch SW21, in the controlling board Z, for descending the end portion 201 of the roll support frame 2 to the paper splicing preparation position is closed to excite the solenoid SO1L of the solenoid-operated valve V1L. Thus, the end portion 201 of the roll support frame 2 is gradually descended to the paper splicing preparation position by its self-weight, by the operation of a pressure regulating valve VL (see FIG. 4) which has been low-pressure regulated in advance. The main paper splicing roll 32 is placed immediately near the new paper roll 93 and the switch SW21 is closed, whereby the electromagnetic brake 231 is operated to hold the roll support frame 2 in this position (see the portion indicated with imaginary lines in FIG. 12). Then, the switch PS1 for operating the predriver in the controlling board Z is closed to rotate the motor 64L for the predriver 61, while the solenoid SO4L for the solenoid-operated valve V4L is excited to cause the belt 633 of the predriver 61 to come into pressing contact with the new paper roll 93 for rotating the paper roll 93 counterclockwise, in the drawing, so that it may be provided with a peripheral speed which is equal to the drawing-out speed of the old paper roll as described hereinbefore. After the volume of the old paper roll 92 is reduced up to the drawing-out end, the pin 722 is released from the paper roll 92 and thus swings freely. Accordingly, the wire 721 or the pin 722 collides with the detecting portion 7231 of the limit switch 723 to close the normally open contact 723 C of the limit switch. The relay L1 (see FIG. 21) is excited by closure of the contact 723C. The relay L1 is maintained in an excited state due to closure of the contact L1/1, thus retaining the closure of the contact L1/2. As the magnet 814 approaches the sensor 811S for the first time after excitation relay L1, the contact 811C of the proximity switch 811 is closed and the relay L2 is excited. The relay L2 is maintained in an excited state due to closure of the contact L2/1. The brake 231 is cut off due to the excitation of the relay L2 to let the roll support frame 2 begin to descend again, whereby the pipe 902 from the old paper roll is pressed, at a position B, against the new paper roll 93 by means of a roll 32 as illustrated with a solid line in FIG. 12.

Figure 13:
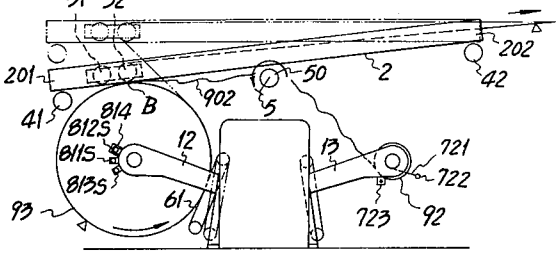

At this time, the beginning end of the new paper roll 93 to be drawn out has already passed the position B, and the magnet 814 approaches the sensor 812S right before the edge of the drawn-out beginning end 921 is rotated to the position B again. The contact 811C of the switch 811 is closed due to the approaching magnet 814 and the relay L3 is excited. The relay L3 is maintained in its excited state due to closure of the contact L3/1. Relay L3 excites the solenoid SO5L of the solenoid-operated valve V5 for rotating the cutter 5 counter-clockwise, in the drawings, as illustrated in FIG. 13, whereby the paper 902 from the old paper roll is cut away. The new paper roll 93 is rotated as it is, and the beginning end to be drawn out is spliced with the paper 902 from the old paper roll by aligning the inside and outside of the roll papers. Thereafter, the roll support frame 2 and the predriver 61 are restored to their original state by a reset timer circuit (not shown), and the roll shaft mounting plates 33, 33 are stopped as they approach the end portion 201 of the frame 2, and the cutter 5 is also stopped in its position. Also, the contact L5/1 (see FIG. 21) for resetting the relay is open temporarily and the relays L1, L2 and L3 are demagnetized.

Figure 14:
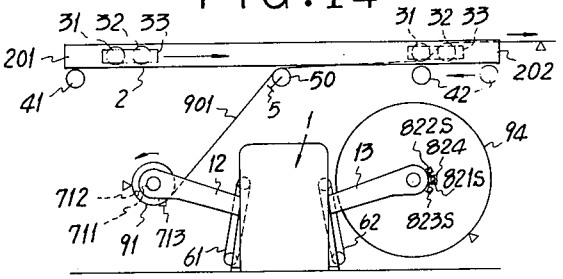

As shown in FIG. 14, the splicing operation of the reverse-face-outside-winding new paper roll 94 which is carried on the rear face side of the mill stand 1 with the reverse-face-outside-winding paper roll 91 which is carried and drawn out on the front face side of the mill stand 1 will be described hereinafter.

Figure 15:
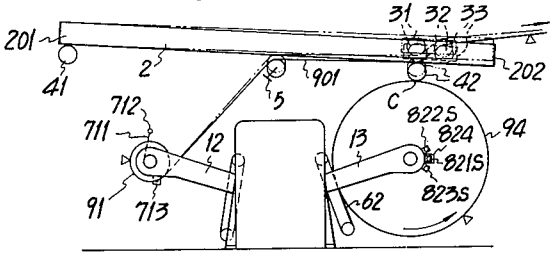

In order to prepare the paper splicing, the paper roll 94 is supported by means of the arms 13 and 13 for counter-clockwise rotation, in the drawing, and both triangularly shaped ears of the beginning end 941 of the paper roll 94 to be drawn out are cut away to form a trapezoid as illustrated in FIGS. 6 and 7. Double-face adhesive tapes 945 and 945 are applied upon the inner face of the beginning end 941 to be drawn out, and single-face adhesive tapes 946 and 946, whose top faces 9461, 9461 are respectively treated into a non-binding condition, are applied to the paper roll outer face 947 which is confronted with the unapplied faces 9451 and 9451 thereof, thereby forming a separating face. The unapplied face 9451 of each double-face adhesive tape 945 placed on the inner face of the beginning end 941 to be drawn out is superimposed on the single-face adhesive tape 946, whose top face is treated into non-binding condition. Double-face adhesive tapes 942 and 942, respectively, having a small area are applied to both the angular outer faces of the beginning end 941 to be drawn out, and the end portion of each tape 942 is extended somewhat beyond the beginning end 941 to be drawn out. The beginning end 941 to be drawn out is serrated, and the serrating lines 943 and 943 respectively surround the periphery of the double-face adhesive tape 942 so that both ends thereof approach the edge of the beginning end 941 to be drawn out. Each end portion of the double-face adhesive tapes 942 and 942 which are extended beyond the beginning end 941 to be drawn out is applied to the outer face 948 of the roll paper. Furthermore, the pin 712 is inserted into the drawn-out end portion from the end face of the old paper roll 91. The edge 944 of the beginning end 941 to be drawn out is set to a position C wherein the paper 901 from the old paper roll is brought into contact with the new paper roll 94 through the manual rotation of the new paper roll 94, as illustrated in FIG. 15.

Figure 17:
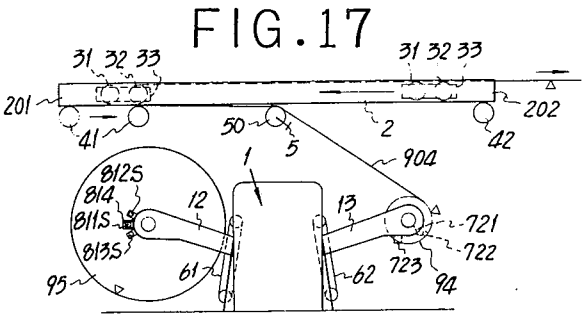
Figure 18:
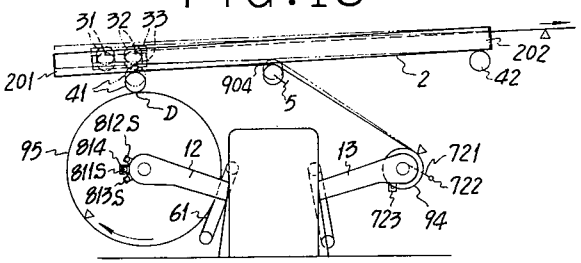
Figure 16:
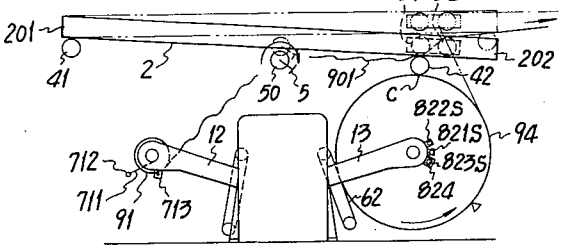

Under this condition, the magnet 824 is near the sensor 821S to re-fix to the shaft 131. Subsequently, as the old paper roll 91 becomes small, the operation switch SW12 for moving the roll shaft mounting plates in the controlling board Z is closed thereby moving the roll shaft mounting plates 33 and 33 near to the end portion 202 of the roll support frame 2. The operation switch SW 32 for moving the auxiliary paper splicing rolls is closed to demagnetize the solenoid SO3R1 for the solenoid-operated valve V3R and to excite the solenoid SO3R2 therefor. Thus, the piston rods 4241 and 4241 on the air cylinders 424 and 424 are retracted thereby moving the auxiliary paper splicing rolls 42 to a position under the main paper splicing roll 31. The contact R4/1 as shown in FIG. 20 is open due to closure of the switch SW32, and the contact R4/2 is closed. Thereafter, the switch SW22 for controlling the roll support frame descending motion is closed causing the roll support frame end portion 202 to descend to a paper splicing preparation position as shown in imaginary lines in FIG. 15. Opening of the switch SW22 with the auxiliary paper splicing roll 42 placed immediately near the new paper roll 94 actuates the electromagnetic brake 232 to suspend the roll support frame 2. Subsequently, the switch PS2 for operating the predriver is closed to cause the predriver 62 to rotate the new paper roll 94 counter-clockwise as shown in the drawing. Thereafter, upon the reduction, in the volume, of the paper roll 91 up to the drawn-out end, the pin 712 is released from the paper roll 91 and thus swinging freely. Accordingly, the wire 711 or the pin 712 collides with the detecting portion 7131 of the limit switch 713 to close the contact 713C of the limit switch. As the magnet 824 approaches the sensor 821S for the first time at the relay R1 (see FIG. 20) has been excited due to closure of the contact 713C, the contact 821C of the switch 821 is closed and the relay R2 is excited. The brake 232 is cut off due to excitation of the relay R2 to let the roll support frame 2 begin to descend again, whereby the paper 901 from the old paper roll is pressed against the new paper roll 94 by means of the roll 42 as illustrated with a solid line in FIG. 15. At this time, the beginning end 941 of the new paper roll 94 to be drawn out has already passed the position C, and the magnet 824 approaches the sensor 823S right before the edge 944 of the beginning end 941 to be drawn out is rotated to the position C again. Then the proximity switch 823 is actuated, and the relay R3 is excited and the cutter 5 is rotated clockwise, in the drawing, as illustrated in FIG. 16 thereby cutting away the paper 901 from the old paper roll. The new paper roll 94 is rotated as it is, and thus the unapplied faces 9421 and 9421 of the double-face adhesive tapes 942 and 942 on the beginning end 94 to be drawn out are applied upon the surface of the roll 42 thereby reversing the beginning end 941 of the paper roll 94 to be drawn out. The unapplied faces 9451 and 9451 of the double-face adhesive tapes 945 and 945 placed on the inner face of the beginning end 941 to be drawn out are applied upon the paper 901 from the old paper roll, whereby the paper splicing operation with the inside and outside of the paper rolls being aligned is performed. Subsequently, as illustrated in FIG. 17, the splicing operation of the front-face-outside-winding new paper roll 94 which is carried on the front face side of the mill stand 1 with the paper roll 94 which is carried and drawn out on the rear face side of the mill stand 1 is performed in the same manner as the splicing operation between the paper rolls 91 and 94. Namely, the beginning end portion of the new paper roll 95 to be drawn out is constructed, in advance, in the same structure as the beginning end portion of the paper roll 94. The new paper roll 95 is rotated manually to align the edge of the beginning end in a paper splicing position D (see FIG. 18). Thereafter, the magnet 814 is adjusted in position and the pin 722 is inserted into the drawing-out end portion from the end face of the paper roll 94. Then, the operation switch SW11 for moving the roll shaft mounting plates is closed to move the roll shaft mounting plates 33 and 33 to near the end portion 201 of the roll support frame. The operation switch SW31 for moving the auxiliary paper splicing rolls is closed to demagnetize the solenoid SO3L1 for the solenoid-operated valve V3L and to excite the solenoid SO3L therefor. Thus, the piston rods 4141 and 4141 on the air cylinders 414 and 414 are retracted thereby to move the auxiliary paper splicing rolls 41 under the main paper splicing roll 32. The contact L4/1 shown in FIG. 21 is open due to closure of the switch SW31 and the contact L4/2 is closed. Thereafter, the switch SW21 for the roll support frame descending motion is closed causing the roll support frame end portion 201 to descend up to a paper splicing preparation position. Opening of the switch SW21 with the auxiliary paperr splicing roll 41 placed immediately near the new paper roll 95 actuates the electromagnetic brake 231 to suspend the roll support frame 2. Subsequently, the switch PS1 for operating the predriver is closed to cause the predriver 61 to rotate the new paper roll 95 clockwise of the drawing. Thereafter, as the volume of the old paper roll 94 is reduced up to the drawing-out end, the pin 722 is released from the paper roll 94 and thus freely swing. Accordingly, the wire 721 or the pin 722 collides with the detecting portion 7231 of the limit switch 723 to close the contact 723C of the limit switch. The magnet 814 approaches the sensor 811S for the first time after the relay L1 (see FIG. 21) has been excited due to the closure of the contact 723C, the contact 811C of the switch 811 is closed and the relay L2 is excited. Then, the solenoid-operated brake 231 is cut off to let the roll support frame 2 begin to descend again, whereby the paper 904 from the old paper roll is pressed against the new paper roll 95 by means of the roll 41 at a position D, as illustrated with a solid line in FIG. 18. At this time, the beginning end of the new paper roll 95 to be drawn out has already passed the position D, and the magnet 814 approaches the sensor 813S right before the edge of the beginning end to be drawn out is rotated to the position D again. The proximity switch 813 is operated to rotate the cutter 5 counter-clockwise, in the drawing, as illustrated in FIG. 19, thereby cutting away the paper 904 from the old paper roll. The new paper roll 95 is rotated as it is, and thus the beginning end to be drawn out is reversed by means of the roll 41. Then, the splicing operation wherein the inside and outside of the roll paper is aligned with that of the paper 904 from the old paper roll is performed. The invention being thus described, it will be obvious that the same may be varied in many ways. Such variations are not to be regarded as a departure from the spirit and scope of the invention, and all such modifications are intended to be included within the scope of the following claims.

What I claim is:

1. An apparatus for splicing a leading end of a fresh web roll which is releasably attached to said roll and which is not yet unwound, with a running web which is being continuously withdrawn from an expiring web roll, without interrupting the continuous operation thereof which comprises a mill stand, roll supporting means for rotatably supporting said fresh web roll and said expiring web roll in said mill stand in mutually opposed positions, each of said roll supporting means including opposing rotating shaft means supported by arm means, means for rotating said fresh web roll and expiring web roll, respectively, a roll supporting frame disposed above said mill stand and extending from a position above the fresh roll to a position above the expiring roll, said roll supporting frame containing splicing rolls rotatably mounted therein which are adapted to guide the running web, means for suspending the roll supporting frame so that each end thereof may move up and down with the other end thereof acting as a pivot point, means for moving said splicing rolls within said roll supporting frame from one end portion of the roll supporting frame to the other end portion thereof, a web guiding roll disposed above the mill stand and below the roll supporting frame, means for supporting said guide roll in said position, said web guiding roll having a cutting means operatively associated therewith for cutting the web running from the expiring web roll after the splicing operation has been achieved, and a detecting system provided on each of said roll supporting means for detecting when the expiring roll is becoming depleted, said detecting system comprising a plurality of proximity switches disposed on one of the arms of the roll supporting means and a detector element attached to the shaft means of said arm and rotatable therewith, a pin inserted into the end face of the web roll at a point near the other shaft means of said web roll, said pin being connected to said shaft means by a wire, a limit switch located in close proximity to said other shaft means so that as the pin becomes disengaged from the web roll due to its reduction in size, said pin or the wire associated therewith will strike and actuate the limit switch which in turn moves the splicing rolls and renders the proximity switches responsive to the detector element, the detection of the detector element by the proximity switches lowering the roll supporting frame to cause the running web to contact the guide roll containing the cutting means and to bring it into engaging relationship with the fresh, fully wound web roll, and to actuate the cutting means, whereby the leading end of the fresh web roll is spliced with the running web of the expiring roll and said running web is cut free from said expiring roll.

2. The apparatus of claim 1, wherein an intermediate roll is suspended below each end portion of the roll supporting frame, said intermediate roll being suspended with a slight play in the vertical direction and a free sliding movement along the roll supporting frame, and means for moving each of the intermediate rolls along the roll supporting frame.

3. The apparatus of claim 1, wherein the detector element is a magnetic means and the proximity switches sense the position of said magnetic means.

4. The apparatus of claim 1, wherein at least a portion of the exposed surface of said leading end is provided with a binding agent.

5. The apparatus of claim 1, wherein the means for rotating either the fully wound web roll or the expiring web roll comprises a conveyor belt, means for rotating said conveyor belt and means for bringing said conveyor belt into engaging and disengaging relationship with said web rolls.

* * * * *